United States Patent [19]

Liebman

[11] 4,065,700

[45] Dec. 27, 1977

[54] D. C. POWERED STROBE LIGHT

[76] Inventor: Theodore Liebman, 8201 Henry Ave., Philadelphia, Pa. 19128

[21] Appl. No.: 702,917

[22] Filed: July 6, 1976

[51] Int. Cl.[2] ..... H05B 37/00

[52] U.S. Cl. ..... 315/241 R; 315/200 A; 315/278

[58] Field of Search ..... 315/200 A, 241 R, DIG. 7, 315/278, 221, 239; 331/112; 340/25, 50, 81 R, 105, 331, 340

[56] References Cited

U.S. PATENT DOCUMENTS 3,237,052 2/1966 Sokolou ..... 315/241 R 4,005,335 1/1977 Perper ..... 315/DIG. 7

*Primary Examiner*—Alfred E. Smith
*Assistant Examiner*—Edward Tyler
*Attorney, Agent, or Firm*—I. Michael Bay-Boychuk

[57] ABSTRACT

A strobe light circuit adapted for use with a battery including a transformer and oscillator connected to charge a storage capacitor disposed across a discharge tube. A fourth winding in the transformer provides the trigger signal to the tube. By this arrangement the trigger pulse becomes progressively higher with increasing charge on the storage capacitor utilizing to best advantage the parameter relationships of the tube.

4 Claims, 5 Drawing Figures

FIG. 1
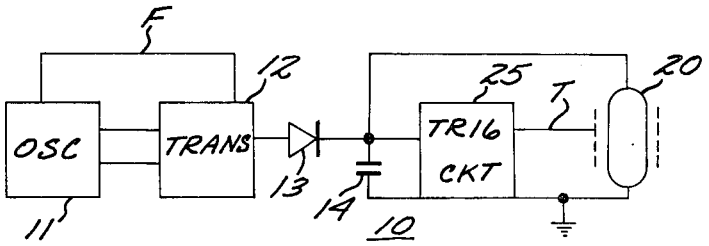
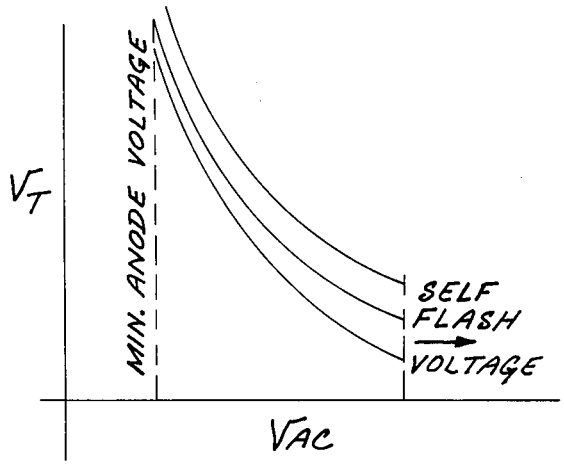
FIG. 2
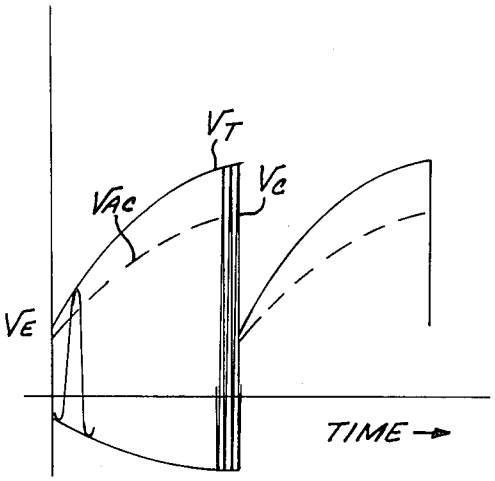
FIG. 5
FIG. 3
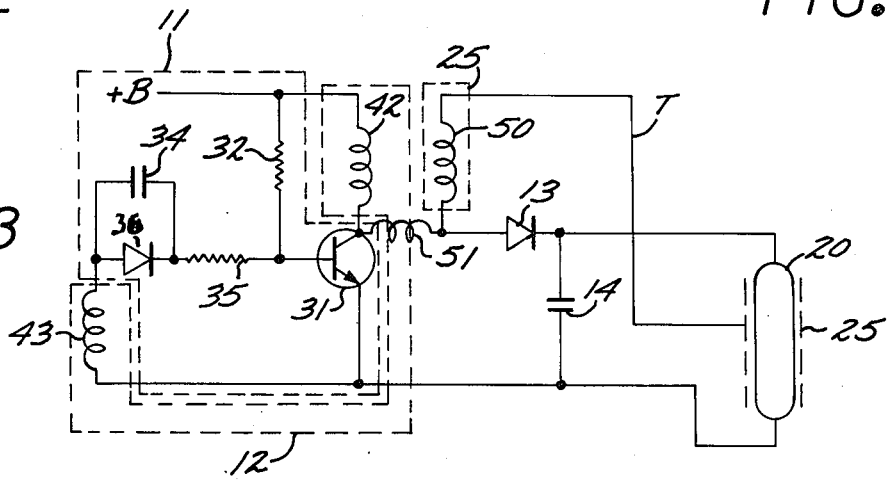
FIG. 4
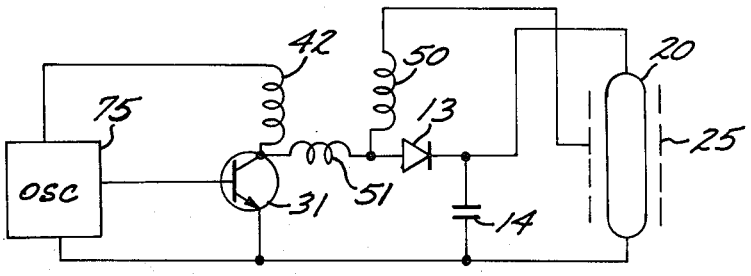

D. C. POWERED STROBE LIGHT

BACKGROUND OF THE INVENTION

1. Field of the Invention

The present invention relates to strobe light circuits, and more particularly to D. C. powered circuits adapted for use with discharge tubes.

2. Description of the Prior Art

The use of strobe lights for various purposes has been known in the past. Quite often, in order to conserve the total power consumed, strobe lights are used as warning or safety markers, particularly around construction sites close to a highway. In these applications such warning lights are frequently left unattended over long periods of time and efficient consumption of stored energy is therefore of paramount importance. In the past various strobe light circuits adapted for this use have been developed where a discharge tube periodically dissipates the power charged up in a capacitor. To concurrently charge up the capacitor and trigger the tube an oscillator circuit was frequently used in such circuits.

Circuits of this kind have been also utilized in entertainment devices which in addition to power considerations also entail some control over strobe accuracy.

Generally a discharge tube requires a decreasing anode to cathode voltage as the trigger voltage increases. As the frequency of the trigger voltage increases, the required anode to cathode voltage also decreases. These phenomena have not been adequately utilized in the past with the result that all prior circuits have been of relatively high complexity.

SUMMARY OF THE INVENTION

Accordingly it is the general purpose and object of the present invention to utilize the reduction of trigger voltage with increasing anode to cathode voltage in a discharge tube to best advantage and thus implement a circuit requiring few parts.

Yet another object of the invention is to provide a D. C. powered strobe light circuit wherein the trigger elements are reduced to a single additional winding in a transformer-oscillator.

Yet further objects of the invention are to provide a strobe light circuit which is easy to produce, convenient to use and requires few parts.

Briefly these and other objects are accomplished within the present invention by utilizing a blocking oscillator having a oscillator transformer connected in a conventional circuit, with the primary thereof in the collector leg of the oscillator transistor and the second leg connected across the base-emitter circuit. This manner of connection provides the necessary positive feedback driving the transistor between its limits. In this conventional configuration, the base-emitter circuit branch is capacitively coupled and therefore when the transistor is off there is usually some reverse current. It is this reverse current that has been a source of energy loss. To conserve energy in this part of the circuit it is presently contemplated to include a forward biased diode connected across said capacitor. This implementation reduces the reverse current transient during the off time of the transistor, with a consequent power saving. The unstable oscillatory characteristics of the circuit, however, are still maintained in the positive current direction.

This circuit configuration is then further modified by providing a fourth winding in the transformer coupled to the collector winding. The upper end of this fourth winding is then directly applied to the trigger connection of the discharge tube. Concurrently the third winding of transformer is connected to charge across a diode, the main storage capacitor connected across the anode to cathode circuit. Thus, what has been heretofore performed by relatively complex circuitry is now achieved by the simple expedient of one additional winding.

By proper selection of the winding turns of the elements of this transformer it is furthermore possible to achieve any desired ratio between the anode to cathode voltage and the trigger voltage. The result is an increasing trigger voltage with an increase in the anode to cathode potential which produces a very consistent triggering frequency. Furthermore, should the trigger voltage vary from flash to flash the combined parameters compensate to produce reliable and consistent triggering.

BRIEF DESCRIPTION OF THE DRAWINGS

FIG. 1 is a block diagram illustrating the general configuration of a circuit constructed according to the present invention;

FIG. 2 is a graphical presentation of the various parameters and their interrelationship in the present invention;

FIG. 3 is a detailed illustration of one circuit adapted for use according to the present invention;

FIG. 4 is yet another, more general, embodimment of the circuits shown in FIG. 3; and FIG. 5 is a graphical illustration showing the relationship between anode voltage against time and trigger voltage against time.

DESCRIPTION OF THE PREFERRED EMBODIMENT

While the following description is primarily directed to a D. C. powered strobe light and is thus dominantly useful in warning and entertainment and flashing devices, such is exemplary only. It is to be noted that various other uses and implementations are possible from the teachings herein and no intent to limit the scope of the invention is expressed by these illustrations.

As shown in FIG. 1 a strobe light circuit generally designated by the numeral 10 comprises an oscillator state 11 connected to a transformer stage 12 which by way of a positive feedback connection F reinforces the oscillations. One output of transformer 12 is, in turn, connected to the anode of a diode 13 which at its cathode charges up a capacitor 14. Capacitor 14 is connected across the anode and cathode terminals of a discharge tube 20. The other output of transformer 12 connects to the trigger connection 25 of flashtube 20. Heretofore it has been this trigger circuit connection 25 that included a significant number of circuit elements in the system. It is one purpose of the present invention to reduce the scope and complexity of this circuit function.

This circuit section provides a triggering signal T to the grid around the discharge tube 20 to initiate the breakdown setting off a flash. Until such breakdown occurs capacitor 14 is accumulating the charge from the successive oscillation transients passed by diode 13. Thus the anode to cathode voltage across tube 20 continuously increases until a level is reached at which breakdown occurs.

To illustrate the relationship between the anode to cathode voltage and triggering level reference is made to FIG. 2. As shown in this figure the triggering voltage $V_T$ is inversely related to the anode-to-cathode voltage $V_{AC}$. The effect of trigger frequency, is again inverse and the breakdown level is once more reduced with increasing frequency component. Accordingly FIG. 2 shows a family of curves $f_1$- $f_3$ where the fundamental frequency of curve $f_1$ is lower than the frequency of $f_2$ and similarly $f_3$.

With this relationship in mind a particular embodiment utilizing to advantage the foregoing phenomena is shown in FIG. 3. As shown in this figure the oscillator 11 comprises a transistor 31 connected in the common emitter mode with the primary 42 of the transformer stage 12 in the collector circuit. The other end of winding 42 is connected to the positive end of a battery +B. That battery end +B is also connected across on resistor 32 to the base of transistor 31. Transistor 31 furthermore includes the secondary winding 43 in its base-emitter circuit connected in circuit with a coupling capacitor 34 in series with a base resistor 35. Capacitor 34 is connected in parallel with yet another diode 36 arranged in forward bias with the emitter junction. Diode 36 allows capacitor 34 to be much smaller, and thereby reduces reverse current transients.

The function of the trigger circuit 25 is performed by a fourth winding 50 in the transformer stage. Winding 50 is connected between the junction of a third transformer winding 51 and the anode of diode 13 to the trigger terminal of tube 20 and is arranged for coupling with winding 42. Thus winding 50 provides the aforementioned trigger signal T. Winding 51 is connected between the collector terminal of transistor 31 and the anode of diode 13 and is therefore floating on the charging signal to diode 13 which, in turn, charges capacitor 14 across the anode - cathode circuit of the tube. It also is arranged for coupling with winding 42 according to the polarity indicated.

Thus, as the charge on the capacitor 14 increases the voltage across winding 50 increases in amplitude. With a proper winding ratio this relationship can be set to the desired region of the tube with a concurrent cumulative effect. By these means the tube discharge occurs at more predictable intervals, at lower power levels and therefore at lower energy loss levels to conserve battery life.

As shown in FIG. 4, other embodiments of the present invention are possible. In this figure various and more generalized transformer and oscillator circuits 75 replace the oscillator components described above. Again the same components like winding 50, diode 13 and capacitor 14 effect the discharge of tube 20. Thus the inventive circuit can be utilized with other oscillator configurations with the same benefit and effect.

The operation of the present invention is set forth by reference to FIG. 2 and with particular reference to FIG. 5. As shown in FIG. 5, as result of the foregoing implementation, the anode to cathode voltage $V_{AC}$ across tube 20 increases with time between the extinguishing level $V_E$ and discharge $V_C$. At the same time the trigger voltage $V_T$ increases in amplitude. Towards the triggering point the frequency component of voltage $V_T$ also increases, thus taking benefit of the relationship of FIG. 2. The rise time furthermore can be conveniently controlled by selection of winding ratios.

Thus a reliable circuit drawing minimal power is formed which furthermore capitalizes on the best features of a discharge tube.

Obviously many modifications and variations to the above disclosure can be made without departing from the spirit of the invention. It is therefore intended that the scope of the invention be determined solely on the claims appended hereto.

I claim:

1. A strobe light circuit powered by a source of direct current, comprising:

oscillating means connected for excitation to said direct current source;

transformer means coupled to said oscillating means and including an additional winding connected between the ends of the primary and secondary thereof;

a discharge tube connected by its anode to said end of said secondary of said transformer means; and trigger means connected between the other end of said secondary and said discharge tube.

2. Apparatus according to claim 1 further comprising:

capacitive means disposed between the anode and cathode of said discharge tube for accumulating the charge developed by said secondary of said transformer means.

3. Apparatus according to claim 2 wherein:

said oscillating means includes a transistor connected by the collector thereof to said primary of said transformer means and the emitter thereof to ground of said direct current source, and a fourth winding in said transformer in circuit with a first diode operatively connected between the emitter and base of said transistor.

4. Apparatus according to claim 3 further including:

a second diode connected in circuit between said one end of the secondary of said transformer means and said anode of said discharge tube.

* * * * *